US007387202B2

(12) United States Patent
Beaty

(10) Patent No.: US 7,387,202 B2
(45) Date of Patent: Jun. 17, 2008

(54) SANITARY, PORTABLE FEEDING KIT FOR CHILDREN

(75) Inventor: James T. Beaty, Huntersville, NC (US)

(73) Assignee: Neat Solutions, Inc., Huntersville, NC (US)

( * ) Notice: Subject to any disclaimer, the term of this patent is extended or adjusted under 35 U.S.C. 154(b) by 220 days.

(21) Appl. No.: 11/415,627

(22) Filed: May 2, 2006

(65) Prior Publication Data

US 2006/0283763 A1 Dec. 21, 2006

Related U.S. Application Data

(60) Provisional application No. 60/676,125, filed on May 2, 2005.

(51) Int. Cl.
*B65D 77/00* (2006.01)
*A45C 11/20* (2006.01)
*A61J 9/06* (2006.01)

(52) U.S. Cl. ..... 206/217; 206/542; 206/548; 222/129; 426/117; 426/120

(58) Field of Classification Search ..... 206/217–218, 206/541–549; 222/129–142; 426/112–117, 426/119–120

See application file for complete search history.

(56) References Cited

U.S. PATENT DOCUMENTS 3,127,984 A * 4/1964 Hertzog ..... 206/545
3,376,974 A * 4/1968 Hilliard ..... 206/217
3,732,955 A * 5/1973 Carter et al. ..... 206/217
4,895,258 A 1/1990 Bertoli
5,180,079 A * 1/1993 Jeng ..... 206/217
5,363,983 A 11/1994 Proshan
5,588,561 A * 12/1996 Ness ..... 222/129
5,753,289 A * 5/1998 Ness ..... 426/394
6,079,586 A * 6/2000 Hanneman ..... 206/217
6,610,339 B1 8/2003 Borgerson
6,820,767 B2 * 11/2004 Nicholas ..... 222/132

* cited by examiner

*Primary Examiner*—Bryon P Gehman
(74) *Attorney, Agent, or Firm*—F. Rhett Brockington

(57) ABSTRACT

A convenient, portable, "all-in-one" kit that contains all of the feeding accessories that a child would require for a meal, and also provides a sanitary environment for eating the meal. The kit is comprised of members including a container member, which is a cup; and closing member, which is a lid with a controlled-flow drinking spout. The cup fitted with the lid is commonly known as a sippy cup. The lidded cup serves as an enclosure for the other members of the kit. The kit also includes a utensil member, such as a spoon or fork or both. The entire kit is inexpensive and therefore disposable after a single usage. A unique feature about the kit is the inclusion of a protective member that is a specialized sheet that can be adhesively fastened to a table or highchair and, as such, provides a sanitary zone for eating the meal.

20 Claims, 8 Drawing Sheets

SANITARY, PORTABLE FEEDING KIT FOR CHILDREN

CROSS REFERENCE TO RELATED PATENT APPLICATIONS

The application claims the benefit of the priority filing date of the provisional patent application, bearing Ser. No. 60/676,125, which was filed on May 2, 2005.

BACKGROUND OF THE INVENTION

1) Field of the Invention

The invention relates to a portable feeding kit, and more particularly a portable feeding kit for children.

2) Prior Art

U.S. Pat. No. 4,895,258 to Luigi Bertoli teaches a compact utensil set, where the set of utensils are contained in a case-container. Bertoli teaches that the set contains all the main things required for consuming food and drink, neatly arranged within a very limited space. A special feature of the set is that all the component parts are made specially to make best use of the space available, to be compact and hygienic, and to keep weight down to a minimum.

U.S. Publication 2004/0245258 to Connors, James A. Jr. et al. teaches a disposable child's drinking cup, which has a lid with a drinking spout defining multiple open holes sized to resist leakage in the absence of suction, such as by the development of surface tension at the holes, and to allow flow when suction is applied. The holes are formed during molding of the lid.

U.S. Pat. No. 5,363,983 to Mary-Elizabeth Proshan teaches a cap for detachably closing a disposable container with liquid therein employs a flat horizontal disc having first and second openings disposed in spaced apart positions therein. The lid has a first opening that is a pinhole, and a second opening that is relatively large. The cap has a hollow vertical spout that tapers upwardly from the disc with an open lower end coincident with the second opening. The open upper of the spout is smaller in area than its lower end.

U.S. Pat. No. 6,610,339 to Michael J. Borgerson teaches a portable container for storing an edible liquid separate from an edible dry component, where the portable container houses a spoon. While the prior art addresses the mechanics of packaging utensils in a container, the prior art is largely centered on products used by adults, and the art is silent on a kit which enhances sanitation and reduces contamination. Sanitation and contamination are of preeminent importance in the care and feeding of children, as children are not innately endowed with knowledge of what can potentially make them sick, and, in general, because their immunological systems are less well developed than an adult's, they are more susceptible to becoming sick. Table 1 has a partial list of pathogens associated with foods and eating. What is needed is a sanitary, portable, feeding kit for children that not only provides the feeding utensils in a clean, compact disposable form, but also provides a protected sanitary zone for eating, and an apparatus to cover the child from spillage.

TABLE 1

Common Foodborne Pathogens

| Pathogen | Infection Symptoms in Humans | Reservoir | Cause of Infection |
|---|---|---|---|
| | | Bacteria | |
| Campylobacter | Fever, diarrhea, abdominal cramps, nausea, vomiting; Most commonly identified cause of diarrheal illness in the world; May cause Guillain-Barre syndrome. | Intestines of healthy birds; Raw poultry meat, cattle and sometimes swine. | Eating undercooked chicken or foods contaminated with juices from undercooked chicken; In developing countries: unchlorinated drinking water supplies, e.g., wells, contaminated with poultry feces. |
| *Salmonella* | Fever, diarrhea, abdominal cramps, headache. | Intestines of birds, reptiles and mammals. | Spread to humans by a variety of foods of animal origin, e.g., undercooked poultry, contaminated eggs (eaten raw) and raw milk; May invade the bloodstream in persons of poor health or weakened immune systems, causing life-threatening infections. |
| *E. coli* O157:H7 | Severe, bloody diarrhea, painful abdominal cramps; not much fever; May cause acute kidney failure, hemolytic uremic syndrome, in children. | Cattle and similar animals; also resides in humans. | Consuming food or water that has been contaminated with microscopic amounts of cow feces; Contaminated raw milk. |
| *Vibrio parahaemolyticus* | Watery diarrhea, abdominal pain. | Estuarine and marine environment and fish and seafood from those environments. | Consuming raw, improperly cooked, or cooked, recontaminated fish and shellfish. |
| | | Viruses | |
| Norwalk-like virus | Acute gastrointestinal illness, usually with more vomiting than diarrhea; Headache, myalgia and low-grade fever. | Infected persons for up to 2 days after diarrhea stops. | Contact with infected persons/food handlers. |
| Hepatitis A | Infects the liver and causes hepatitis A virus: fever, malaise, nausea, abdominal discomfort, dark urine and jaundice. | Feces of infected people; Poor sanitation and crowding facilitate transmission. | Person-to-person fecal-oral route by infected food handlers. |

TABLE 1-continued

| Common Foodborne Pathogens | | | |
|---|---|---|---|
| Pathogen | Infection Symptoms in Humans | Reservoir | Cause of Infection |
| | | Protozoa | |
| *Toxoplasma gondii* | No symptoms but possible diarrhea; Infected pregnant women may pass the disease to their fetuses, resulting in death of the fetus or severe health effects, such as mental retardation. | Found in virtually all animal foods. | Consuming raw or undercooked meat or contact with cats that shed cysts in their feces during acute infection. |
| *Cryptosporidium parvum* | Profuse watery diarrhea; Life-threatening among the immunocompromised. | Waterborne or found in animal manures. | |

SUMMARY OF THE INVENTION

In the broadest sense, the invention is a convenient, portable, "all-in-one" kit that can be easily transported and which contains all of the feeding accessories that a child would require for a meal, and also provides a sanitary environment for eating the meal. The kit is comprised of members, including a container member, which is a cup; and a closing member, which is a lid with a controlled-flow drinking spout. The cup, when fitted with the lid having a controlled-flow drinking spout, is commonly known as a sippy cup, where a sippy cup is refillable. The cup, capped with the lid, serves as an enclosure for the other members of the kit, as well as a drinking vessel. The kit is further comprised of a utensil member, such as a spoon or fork or both, that is a feeding utensil, which is sized so as to fit within the cup. All of the members of the kit are relatively inexpensive, so that the entire kit can be considered disposable after a single usage. None of the members of the kit are believed to present a choking hazard; however, the kit should only be used with adult supervision. The feeding utensil(s) is/are relatively flexible and have no sharp points or edges, and are believed to be safe; however, the kit should only be used with adult supervision. Substantially, each member of the kit is engineered so as to be appropriate for a supervised child, and to be contained within the interior of the cup. It is anticipated that members of the kit are not only functional, but are also engaging to the child. The cup is appropriately sized for a child under the age of about six years, and has a volume of 6-12 ounces, and more preferably 8-10 ounces. The cup, (i.e. container member), preferably is composed of plastic and has a rim with a rounded lip. The lid (i.e. closing member) is preferably composed of plastic and is a snap-on lid. The feeding utensil (i.e. utensil member) is preferably composed of plastic, and has a length, such that when enclosed in the cup and lid, the utensil is snuggly restrained at an angular orientation within cup against the lid. The kit is normally packaged for sale with the lid inverted, such that the drinking spout is protected inside the cup. The kit is further comprised of a packaging member, which is a plastic film such as shrink-wrap. The cup and the inverted lid and cup are substantially completely enclosed by the packaging member. The plastic film holds the lid on the cup and protects the contents from contamination. By packaging the kit with the lid inverted, the kit advantageously takes up less shelf room and is stackable.

The kit is further comprised of a protection member that provides a sanitary zone for eating the meal. The protection member is a specialized sheet that, when folded, fits within the interior of the lidded cup, and when unfolded provides an eating area free of contamination for placement of food and utensils. The specialized sheet is sized so that a protective contamination-free zone is created between the child's eating area and the supporting surface underneath it, which may be soiled or contaminated with pathogens or detritus. The specialized sheet is comprised of a material selected to have good lay flat (drape) properties after being unfolded. The flatness of the specialized sheet can be augmented with strips of double-sided pressure-sensitive adhesive tape. The double-sided pressure-sensitive adhesive tape is covered with a protective release liner. The tape is positioned along the edges of the backside of the specialized sheet, so that the specialized sheet can be smoothed flat and tensioned between the strips of tape. The specialized sheet can be printed, and if so, the printing is preferably reverse printed to ensure that no ink comes into contact with food or utensils or the child. The protection member works synergistically in concert with the other members of the kit to provide a sanitary zone for eating, even in areas that would otherwise present an unacceptable risk that the child may become sick from the ambient pathogens.

The kit is further comprised of a covering member that provides a barrier from spillage. In one embodiment the covering member is a disposable bib having an adjustable fastening means. The packaged bib is folded rectangularly so as to easily fit within the interior volume of the lidded cup. The bib is preferably comprised of a printed nonwoven material with a polymeric backside coating, such that only the front side of the bib is absorbent. The nonwoven material is selected such that it will unfold to a substantially flat material, where residual creasing is not sufficient to cause distortion of the bib. The adjustable fastening means is comprised of a sectional neck strap that is perforatedly attached, and a means for adhesively connecting the sections of the neck strap. One section of the neck strap has a pressure-sensitive double coated fastening tape protectively covered with a removable release liner, and the other section has a target tape attached to the front side of the bib. The neck strap is opened into sections by tearing along the perforations. The strap is adhered by peeling the release liner off the fastening tape, and pulling the strap and the bib around the wearer's neck until it is approximately chin high, and then adhering the fastening tape to the release side of the target tape. The strap can be adjusted by repositioning where the fastening tape adheres to the target tape, or the strap can be released by peeling the fastening tape off the target tape.

The kit can be further comprised of a cleaning member, such as a wipe, a napkin, Kleenex, a dental product, an antibacterial lotion, and soap. The kit can be further comprised of a resealing member, such as a resealable bag, and a cot for sealing the drinking spout.

The kit exists in substantially two states, either in the closed state or in the open state. In the closed state the contents are wrapped in the plastic film (i.e. packaging member), and the kit is portable. In the open state the plastic film is removed, the specialized sheet (i.e. protective member) is unfolded providing a substantially flat, contamination-free eating area, the refillable sippy cup (i.e. the container member capped with the closure member) is ready for filling with a liquid, the feeding utensils (i.e. the utensil members) are available for use, and the bib (i.e. the covering member) is available to be strapped around the child. If other members, such as the cleaning member and the resealing member, were in the kit, then they are available for use.

BRIEF DESCRIPTION OF THE DRAWINGS

The foregoing and other objects will become readily apparent by referring to the following detailed description and the appended drawings in which.

DETAILED DESCRIPTION

Figure 1:
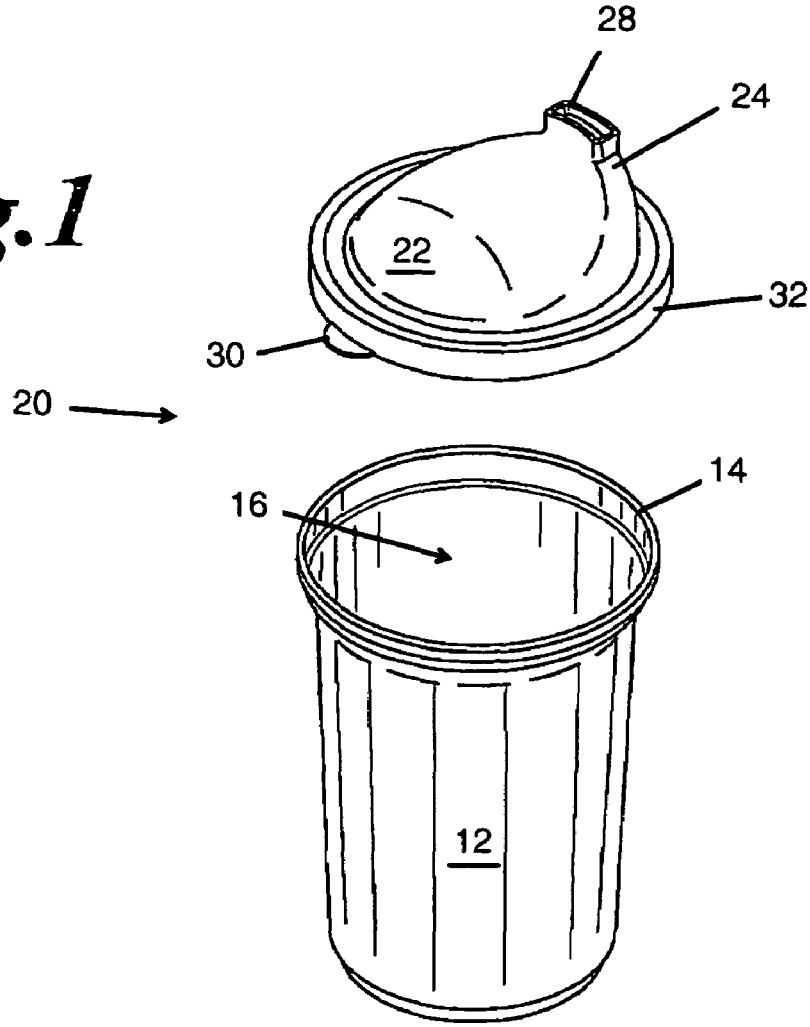
FIG. 1 is an exploded view of the sippy cup comprised of a container member (cup) and a closure-member (lid)
Figure 1A:
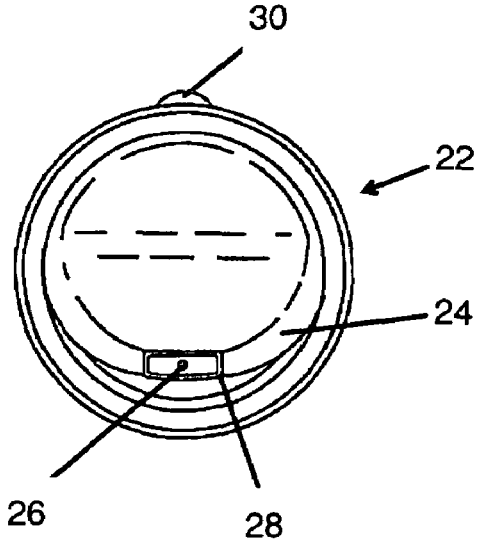
FIG. 1*a* is an overhead view of the closure member (a lid with tapered controlled-flow drinking spout)
Figure 4:
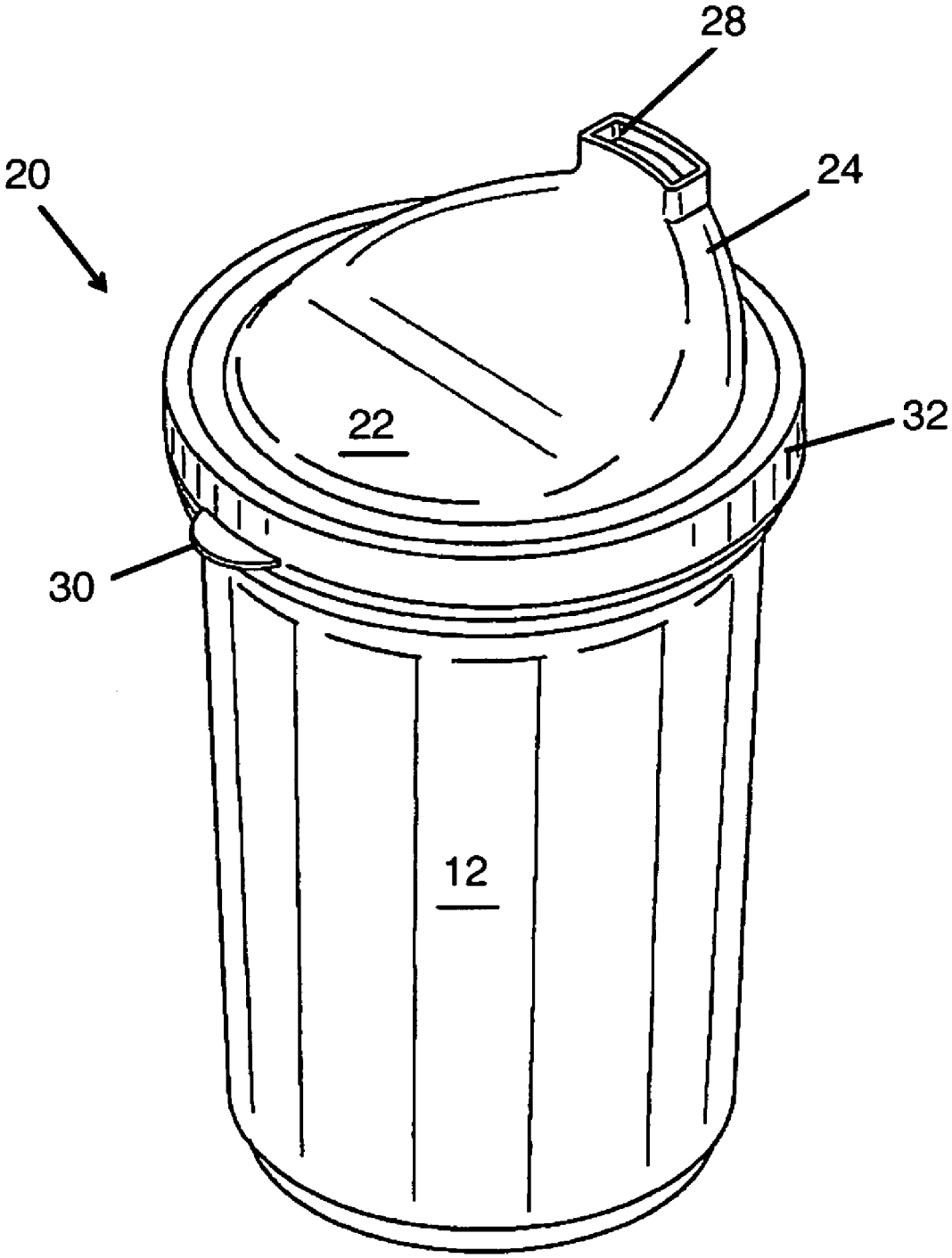
FIG. 4 is a perspective view of the sippy cup.

The invention is a sanitary, portable, feeding kit 10 for children. In a prepackaged compact form the kit 10 provides a drinking cup 22 and feeding utensils 40 all in a clean, compact disposable form. The kit further includes accoutrements for providing a protected sanitary area for eating, a bib, and, optionally, cleaning and resealing supplies. As illustrated in FIG. 1, a sippy cup 20 is comprised of a cup 12 and a lid 22 with a controlled-flow drinking spout 24. The cup 12, which as a member of the kit, is generically referred to as a container member 12, and the lid is a referred to as a closing member 22. The cup is plastic, and has a rim 14 with a rounded lip. The lid 22, which snaps on the rim 12 of the cup, has a circular ridge 32 and a finger tab 32 for removing the lid. The drinking spout 24, which projects from the plane of the lid, is tapered, and as can be seen in FIG. 1*a*, has a single opening 26 which restricts the rate of flow of liquid exiting the sippy cup 20. The tapered drinking spout 24 enables drinking to be effected using a combination of sucking and taking small sips. The sip size is generally restricted to the size of a well 28 formed in the spout. This combination of cup 12 and lid 22 is well known as a sippy cup 20. The single outlet hole 26 is advantageous, as air is substantially occluded while drinking, and after several swallows the flow slows until the sippy cup 20 is turned upright and ambient air can reenter the sippy cup clearing the outlet hole 26. The single hole minimizes spillage, while at the same time teaches the user to take small sips. Only a small amount of the liquid in the sippy cup 20 will seep out if the sippy cup 20 is turned over. The sippy cup 20 with the lid snapped on is illustrated in FIG. 4. As can be seen in FIG. 1*a*, the outlet 26 is located in the bottom of the well 28.

Figure 2:
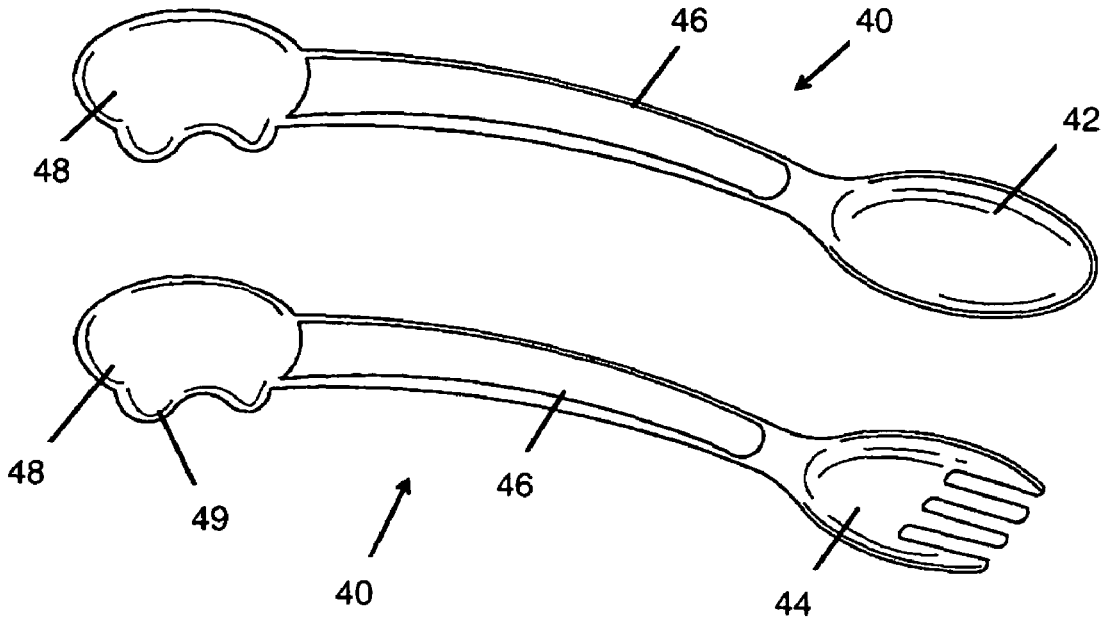
FIG. 2 is a perspective elevational view of utensil members (a spoon and a fork)
Figure 3:
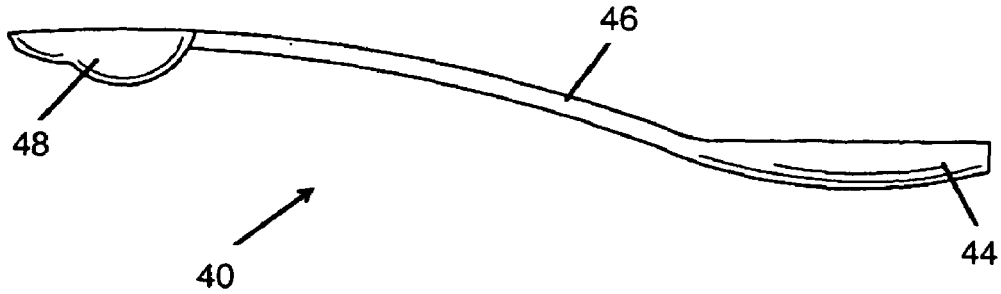
FIG. 3 is a perspective side view of the fork.

The kit 10 is further comprised of a utensil member 40, as shown in FIG. 2. The utensil member 40 is preferably two members, a spoon 42 and fork 44. The stem 46 of the utensil 40 is preferably slightly curved, both lengthwise and crosswise, as shown in FIG. 3. The crosswise arc creates what in effect is a ridge, so that when the stem 46 is stressed, it is in a compressed state, which imparts additional strength to the utensil 40. The gripping end 48 of the utensil's stem, sometimes called the bit, is widened so as to ergonomically enhance the ease of gripping, therein making it easier to access the bottom of the cup or another relatively deep container for food without extending one's fingers much beyond the rim. The ergonomic grip 48 prevents probable contact between the fingers and the food, and the probable coincidental contamination of the food and the user's hand. The widened gripping end 48 of the stem 46 is also preferably decorous with a final 49, wherein the final 49 is an imprinted or embossed design area.

Figure 4A:
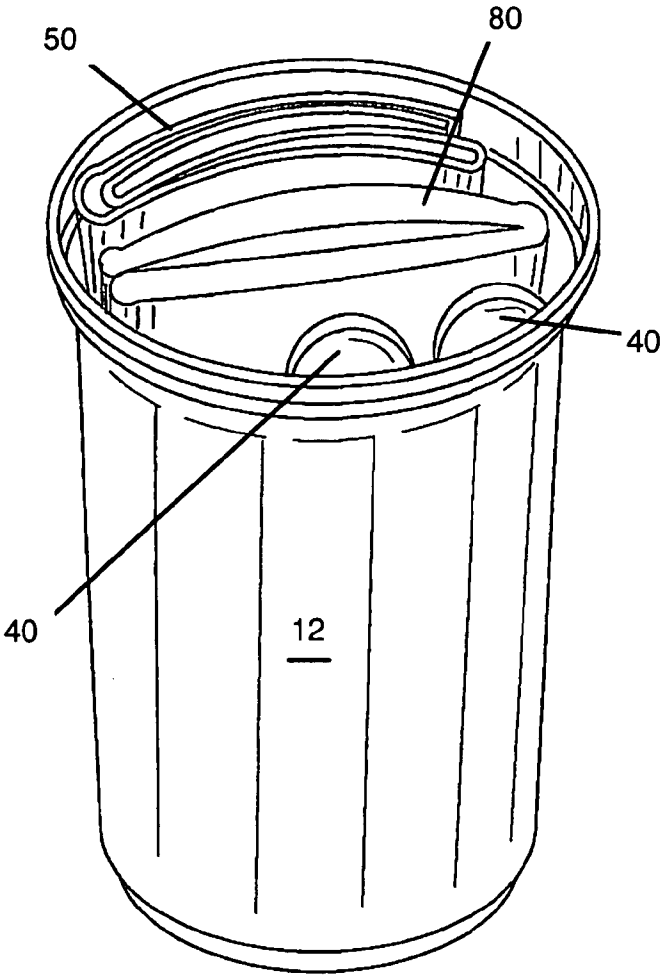
FIG. 4*a* is a perspective view of the cup containing all the members, folded, and packed in the interior of cup.
Figure 6A:
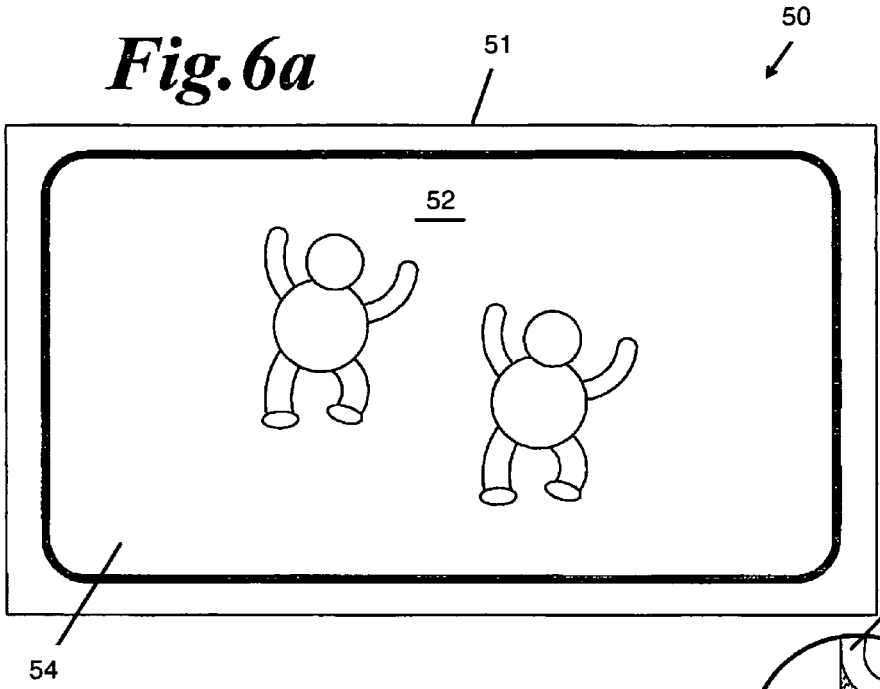
FIG. 6*a* is a plan view of the front of the protective member (specialized sheet)
Figure 6B:
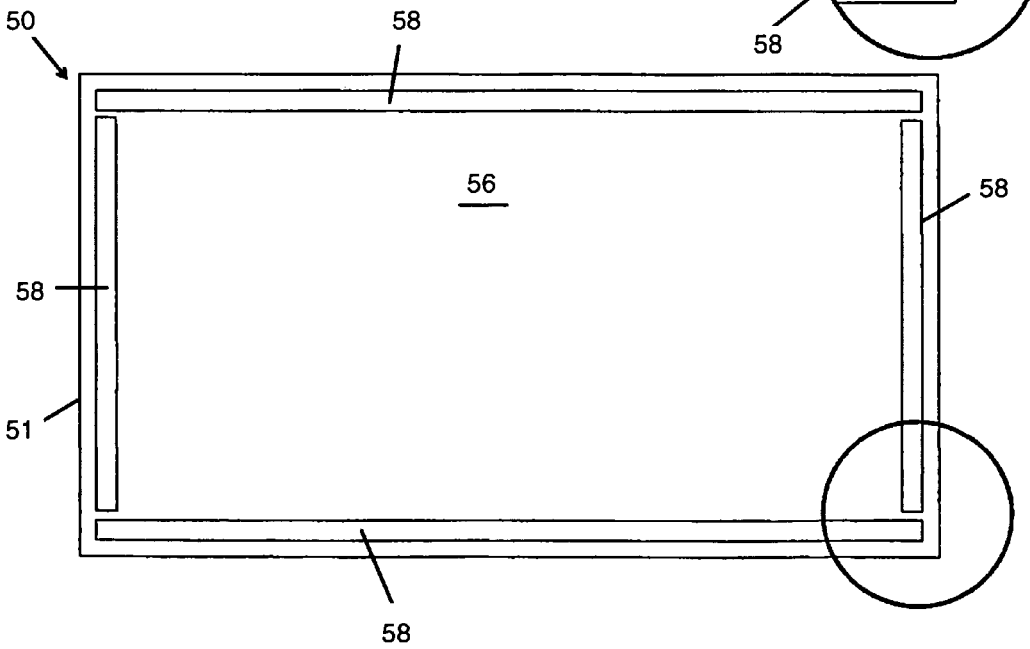
FIG. 6*b* is a plan view of the rear of the protective member (specialized sheet)
Figure 6C:
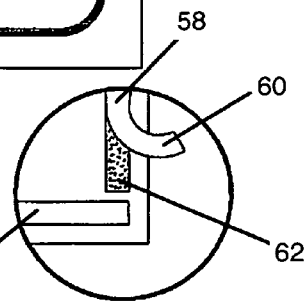
FIG. 6*c* is an exploded view of the double-sided tape shown in FIG. 6*b*, wherein the release liner has been partially pulled away.
Figure 8:
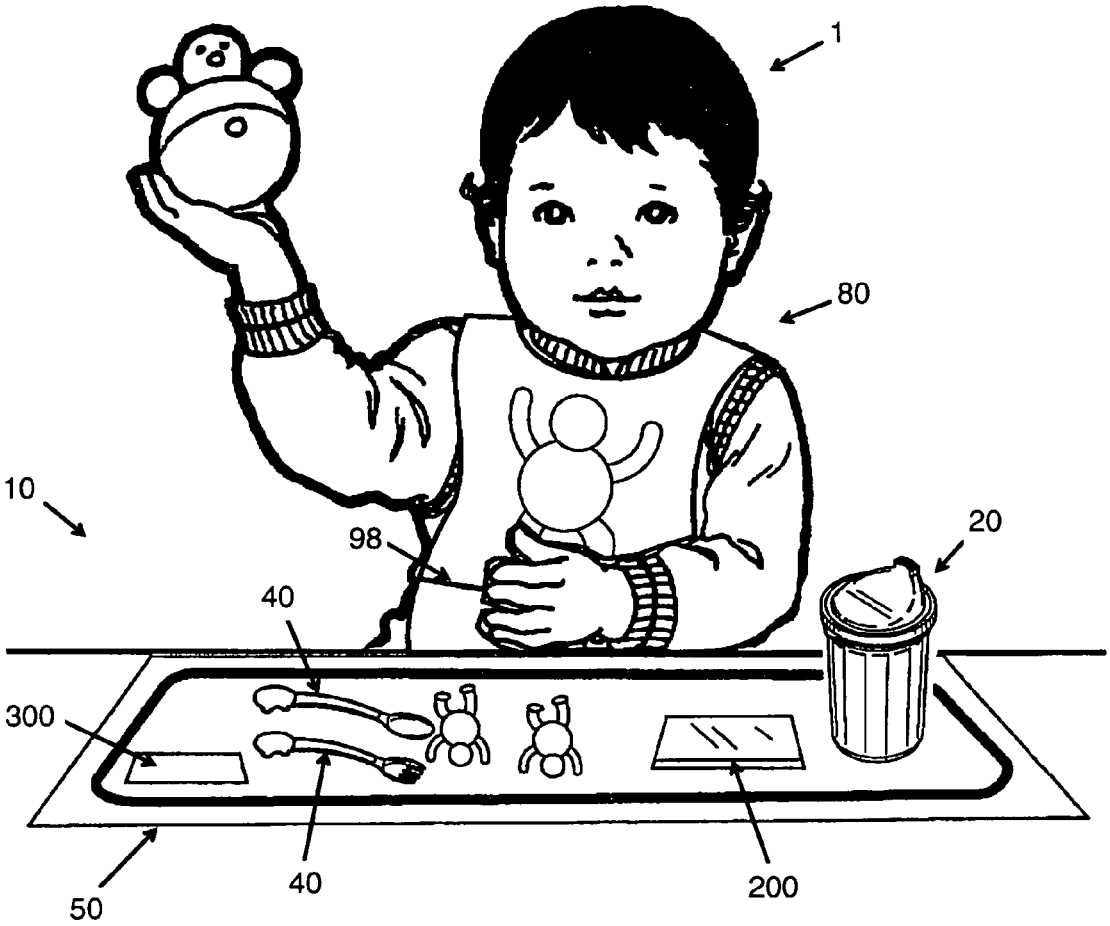
FIG. 8 is an elevational perspective view of an open kit, illustrating a substantially flat protective member (specialized sheet) adhered to an underlying surface, and resting on the front of the protective member is a fork and a spoon, a sippy cup partially filled with a liquid, a cleaning member (wipe), a resealing member (resealable bag), and a covering member (bib). Not shown is the packaging film, which has been disposed of when removed. The specialized sheet provides a sanitary zone for eating the meal.

The kit is further comprised of a protection member 50, as shown in FIGS. 6*a*, 6*b* and 6*c*, which provides a sanitary zone for eating the meal. The protection member 50 is comprised of a sheet of material 51, such as a flexible plastic film that, when folded, fits within the interior of the lidded cup 12, as shown in FIG. 4*a*, that when unfolded provides an eating area free of contamination for placement of food and utensils. The specialized sheet 50 is sized so that the front side 52 of the protection member 50 is a protective contamination-free zone between the child's eating area and the supporting surface underneath it, which may be soiled or contaminated with pathogens or detritus. Examples of supporting surfaces are tables, highchairs, trays, and the ground. The sheet material 51 has good, lay flat (drape) properties after being unfolded. The front 52 of sheet, as shown in FIG. 6*a* and FIG. 8, has a kid's entertainment center 54. The center 54 can for instance have a picture of their favorite characters, instructional information, or outlines for their dinnerware. FIG. 6*b* is planar view of the back 56 of the protective member 50. The edges are framed with strips of a double-sided pressure-sensitive tape 58, which is covered with a release liner 60. As shown in FIG. 6*c*, the adhesive 62 is exposed upon removal of the release liner 60. The tape 58 ensures that the protective member is flat, and difficult for the child to lift up, therein providing a sanitary zone for eating, even in areas that would be otherwise present an unacceptable risk that the child may become sick from the ambient pathogens. As illustrated, the protective member, which is a clear plastic, is reverse-printed to ensure that no ink comes into contact with food or utensils 40 or the child 1.

Figure 5B:
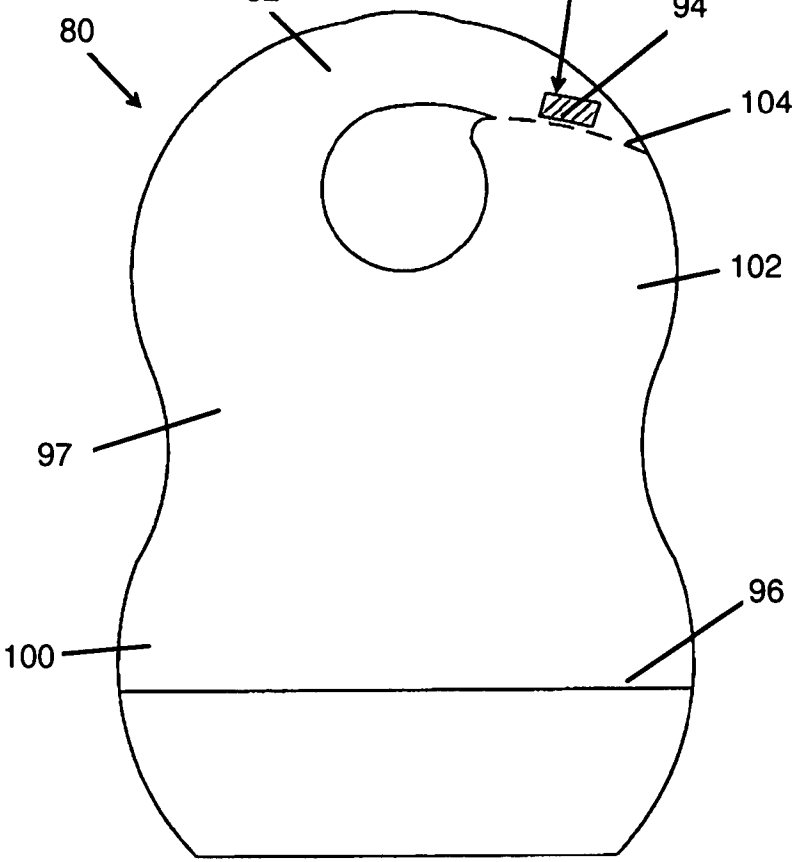
FIG. 5*b* is a rear view of the bib with the strap perforatedly attached.
Figure 5A:
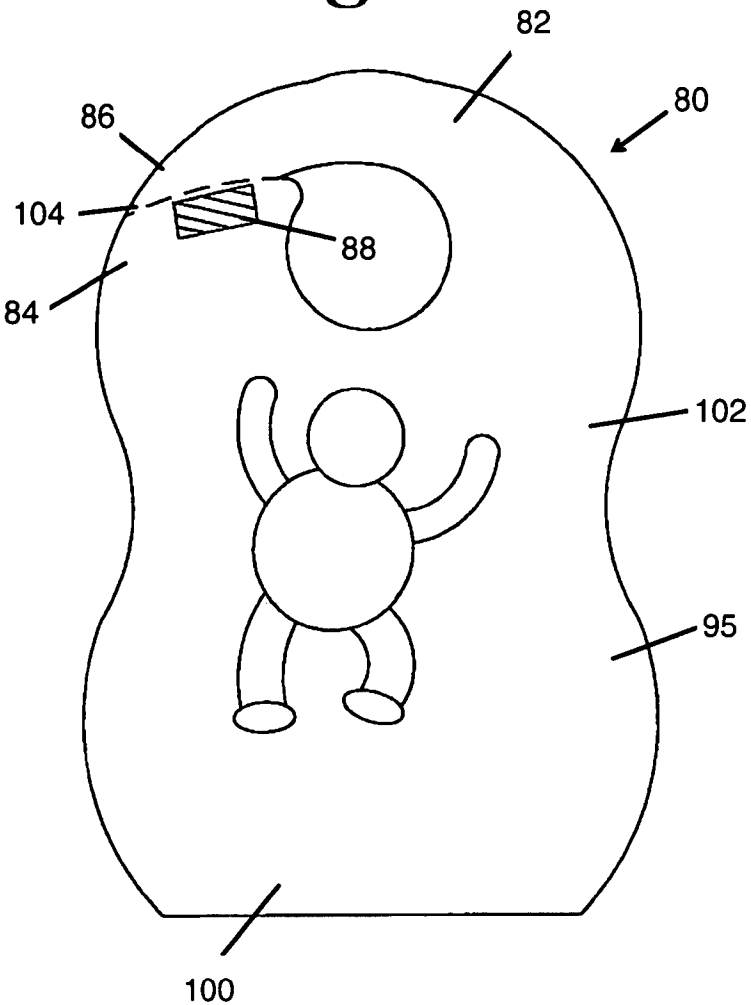
FIG. 5*a* is a frontal view of the covering member (bib) with the strap perforatedly attached.
Figure 5D:
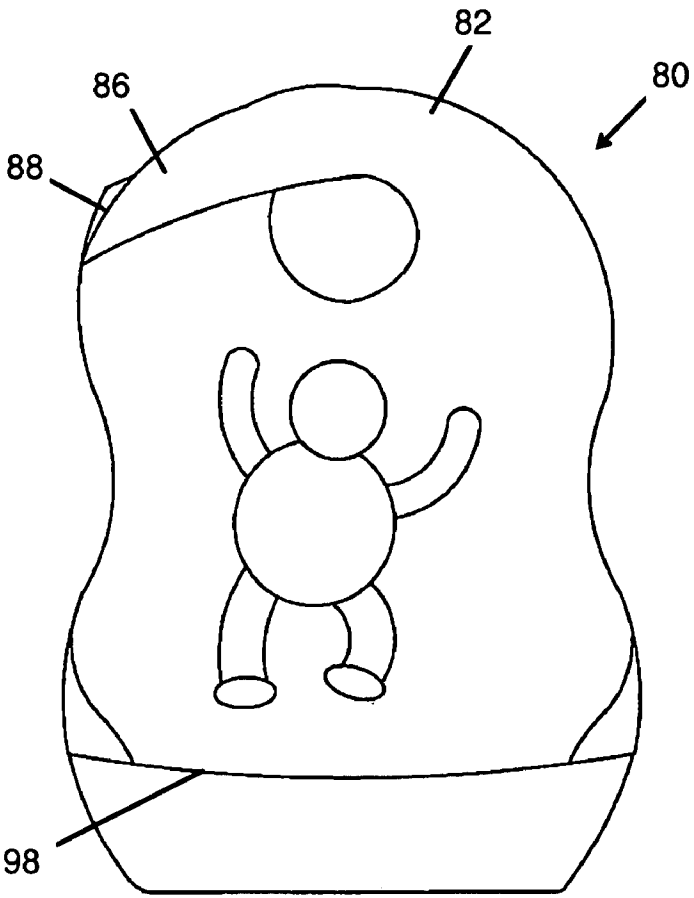
FIG. 5*d* is a front view of the bib with the strap detached.
Figure 5C:
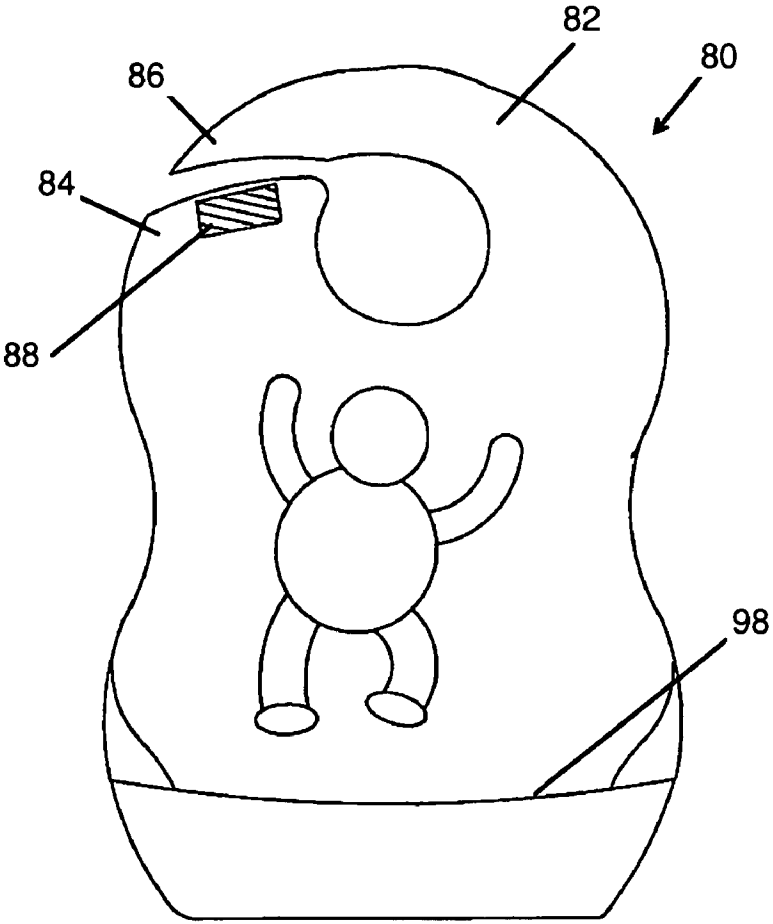
FIG. 5*c* is a front view of the bib with the strap adhesively attached.

The kit is further comprised of a covering member 80, which is illustrated in FIGS. 5*a*-5*d*. The covering member, which is a disposable bib 80, provides a barrier from spillage. The disposable bib 80 has an adjustable fastening means that is a repositionable adhesive—target system. The target tape 84 enables the adhering tape 92 to be adhered, and released, multiple times without delaminating the bib material. The bib, packaged in the cup of the unopened kit, is folded rectangularly so as to easily fit within the interior volume 16 of the cup 12. The bib 50 is composed of a printed nonwoven material with a polymeric coating on the backside 97, where the front side 95 of the bib is absorbent, whereas the back 97 of the bib is not. The nonwoven material is selected such that it unfolds to a substantially flat material, where residual creasing does cause distortion of the bib 80. The neck portion of the bib has a sectional neck strap 82 that is perforatedly attached, so that the sectional neck strap can be easily separated, where upon separation there is first section 84 and a second section 86. The perforations 104 divide the first 84 and second 86 sections. As illustrated, the front 95 of the bib has the target tape 8 on the first section 84 of the strap 82, as shown in FIG. 5*a*. The backside 97, as shown in FIG. 5*b*, of the bib 80 has a double-sided adhesive tape 92 on the second section 84. The double-sided adhesive fastening tape 92 is covered with a release liner 94. The strap 82 is adhered by peeling the release liner 94 off the fastening tape 92, and pulling the strap 82 and the bib around the child's neck until it is approximately chin high, and then adhering the fastening tape 92 to the release side of the target tape 88, as shown in FIG. 5*d*. The strap 82 can be adjusted by repositioning where the fastening tape 92 adheres to the target tape 88, or the strap 82 can be released by peeling the fastening tape 92 off the target tape 88, as shown in FIG. 5*c*. The bottom portion 100 of the bib has an inverted crumb catcher 98. Prior to forming the inverted crumb catcher, the crumb catcher is a sealed pocket 96 on the backside 97 of the bib 80. When sealed pocket 96 is inverted, the inverted seals cause the pocket to flare, therein creating a crumb catcher 98 on the front of the bib. FIG. 5*b* illustrates the sealed pocket 96 prior to inverting, and FIG. 5*d* illustrates the crumb catcher 98 after the sealed pocket 96 has been inverted.

Figure 7:
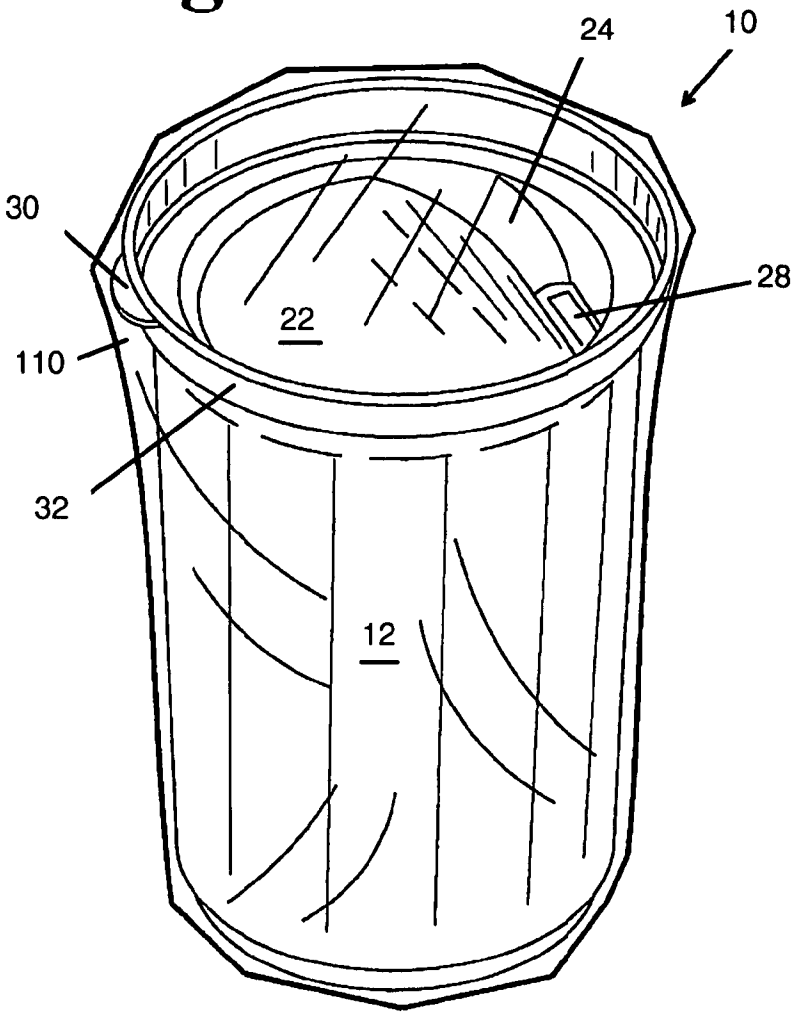
FIG. 7 is a side view of a closed kit, illustrating the container member (cup) and the closing member (inverted lid) enclosed in the packaging member (plastic film); the folded covering member (bib), the folded protective member (specialized sheet), and the utensil members (spoon and fork) are enclosed within the container member (cup) and the closing member (inverted lid)

The kit 10, prior to being opened, is illustrated in FIG. 7. As is apparent, the lid 22 is inverted so that the feeding spout 24 is in the interior 16 of the cup 12. The lid 22 and cup 12 are completely enclosed by a packing member 110, which is a plastic film. The plastic film holds the lid 22 in place. As can be seen in FIG. 4*a*, where the packing member 110 and the lid 22 are removed, the other members are enclosed in the cup 12. The bib 80 and the specialized sheet 50 are folded and inserted in the cup 12, along with two utensil members 40. The utensil members 40, when angled, are near the rim 14 of the cup 12. The length of the utensil members 40 is sized so that they can suitably fit inside the cup 12. As shown, the cup is 9-10 ounces in volume.

FIG. 8 illustrates the kit 10 after it has been opened, and is being used. The packaging member 110 has been removed, liquid has been added to the sippy cup 20, and the lid 22 is snapped on. The protective member 50 has been unfolded, and adhered to the table where the child 1 is eating. The covering member 80 has been unfolded, separated along the perforations, the sealed pocket 96 has been inverted forming the inverted crumb catcher 98, and the sections of the strap 82 are adhesively fastened around the child's neck. The plastic utensil members 40 are set out on the protective member 50. Two other members of the kit have been added, and are at ready. There is a cleaning member 300 which is a wipe, and a resealing member 200 which is a resealable plastic bag. The characters on the child's printed bib match the characters on the entertainment center 54 reverse-printed on the backside 56 of the protective member 50. Even the ergonomic grips 48 on the spoon 42 and fork 44 have characters embossed and outlined on the finals 49. After the meal, the bib 80 can be removed and stacked on the protective member 50, and the entire kit can be disposed. Alternatively, if the child is still drinking, or will want to drink later, everything but the sippy cup 20 can be disposed, and the sippy cup 20 can continue to be used.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim is expressed as a means or step for performing a specified function, it is intended that such claim be construed to cover the corresponding structure, material, or acts described in the specification and equivalents thereof, including both structural equivalents and equivalent structures.

What is claimed is:

1. A sanitary, portable, feeding kit for children, said kit comprising: a container member; a closing member; a utensil member; a protective member, where said protective member is a specialized sheet that can be folded and unfolded; a packaging member; wherein, when the kit is closed, the packaging member encloses the container member and the closing member, and the container member and the closing member enclose the utensil member and the folded protective member; wherein, upon removal of the packaging member the kit is open, and the closing member fitted on the container member provides a refillable sippy cup, the utensil member provides feeding utensils, and the protective member, when unfolded, provides a substantially flat specialized sheet that is a contamination free eating area.

2. The kit as claimed in claim 1, wherein said container member is a cup, and said closing member is a lid with a controlled-flow drinking spout.

3. The kit as claimed in claim 2, wherein said utensil member is sized to fit into an interior volume of the cup with the lid inverted, such that the drinking spout of the lid projects into the interior volume.

4. The kit as claimed in claim 1, wherein said packaging member is a plastic film.

5. The kit as claimed in claim 1, wherein said protective member is a specialized sheet that has a front side that is sanitary, and a backside that is fitted with strips of double-sided pressure-sensitive adhesive tape covered with a removable protective release, therein enabling the specialized sheet to be fastened to an underlying support.

6. The kit as claimed in claim 5, wherein said specialized sheet provides a sanitary zone for eating, creating a barrier between the sanitary front side of sheet and the underlying support which may be contaminated with pathogens and detritus.

7. The kit as claimed in claim 1, wherein said kit is further comprised of a cleaning member selected from the group consisting of a wipe, a napkin, a facial tissue, a dental product, an antibacterial lotion, and a soap.

8. The kit as claimed in claim 1, wherein said kit is further comprised of a resealing member adapted to seal a member of the kit.

9. The kit as claimed in claim 1, wherein said kit is further comprised of a covering member adapted to function as a bib.

10. A sanitary, portable, feeding kit for children, said kit comprising: a container member; a closing member; a utensil member; a protective member, where said protective member is a specialized sheet that can be folded and unfolded; a packaging member; a covering member, where said covering member is a disposable bib that can be folded and unfolded; wherein, when the kit is closed, the packaging member encloses the container member and the closing member, and the container member and the closing member enclose the utensil member, the covering member, and the folded protective member; wherein, upon removal of the packaging member the kit is open, and the closing member fitted on the container member provides a refillable sippy cup, the utensil member provides feeding utensils, and the protective member, when unfolded, provides a substantially flat sheet that is a contamination-free eating area; and wherein, upon removal, the covering member can be unfolded and the bib can be fastened on a child.

11. The kit, as claimed in claim 10, wherein said bib is comprised of a printed nonwoven material with a polymeric backside coating, such that only the front side of the bib is absorbent, and where said nonwoven material is selected such that the bib will unfold to a substantially flat material, where residual creasing is not sufficient to cause distortion of the bib.

12. The kit, as claimed in claim 10, wherein said bib has an adjustable fastening means comprised of a sectional neck strap that is perforatedly attached, and a means for adhesively connecting the sections of the neck strap, where one section of the neck strap has a pressure-sensitive double-coated fastening tape protectively covered with a removable release liner, and the other section has a target tape attached to the front side of the bib; and wherein the neck strap is opened into sections by tearing along the perforations.

13. The kit, as claimed in claim 12, wherein said strap is fastened by peeling the release liner off the fastening tape, and pulling the strap and the bib around the child until it is approximately chin high, and then adhering the fastening tape to the release side of the target tape; and wherein said strap is repositioned by adjusting where the fastening tape adheres to the target tape; and wherein said strap is released by peeling the fastening tape off the target tape.

14. The kit as claimed in claim 10, wherein said protective member is a specialized sheet that has a front side that is sanitary, and a backside that is fitted with strips of double-sided pressure-sensitive adhesive tape covered with a removable protective release, therein enabling the specialized sheet to be fastened to an underlying support.

15. The kit as claimed in claim 14, wherein said specialized sheet provides a sanitary zone for eating, creating a barrier between the sanitary front side of sheet and the underlying support which may be contaminated with pathogens and detritus.

16. The kit as claimed in claim 10, wherein said utensil member has an ergonomic grip comprised of a curved stem with a widened gripping end, where said stem allows access to a relatively deep container without extending a user's fingers much beyond a rim of the container.

17. The kit as claimed in claim 16, wherein said ergonomic grip prevents probable contact between the fingers and food in the container, and the probable coincidental contamination of the food and the user's hand.

18. The kit as claimed in claim 16, wherein said widened gripping end of the stem is decorous with a final, wherein the final has a design area that is one of imprinted and embossed.

19. The kit as claimed in claim 10, wherein said container member is a cup, and said closing member is a lid with a controlled-flow drinking spout.

20. The kit as claimed in claim 19, wherein said lid has a single opening, where said single opening is an outlet for the drinking spout.

* * * * *